United States Patent [19]

Gay

[11] 4,373,650

[45] Feb. 15, 1983

[54] CONTINUOUS CUTTER FOR A GLASS FIBER CHOPPER

[75] Inventor: Benjamin A. Gay, Huntington Beach, Calif.

[73] Assignee: PPG Industries, Inc., Pittsburgh, Pa.

[21] Appl. No.: 223,563

[22] Filed: Jan. 8, 1981

[51] Int. Cl.[3] ..... D01G 1/04

[52] U.S. Cl. ..... 225/97; 83/347; 83/663; 83/913; 225/103

[58] Field of Search ..... 83/346, 347, 663, 672, 83/673, 674, 835, 913; 407/52; 409/232, 234, 236; 225/97, 103

[56] References Cited

U.S. PATENT DOCUMENTS

| | | | |
|---|---|---|---|
| 1,152,030 | 8/1915 | Blond et al. | 409/236 |
| 1,354,828 | 10/1920 | Harvey | 407/52 X |
| 1,511,054 | 10/1924 | Duncan | 83/346 X |
| 2,247,529 | 7/1941 | Taylor et al. | 83/913 X |
| 2,265,649 | 12/1941 | Krehbiel | 83/663 X |
| 3,151,513 | 10/1964 | Rowlands | 83/346 |
| 3,324,753 | 6/1967 | Lindau | 83/672 X |
| 3,508,461 | 4/1970 | Stream | 83/344 |
| 3,644,109 | 2/1972 | Klink et al. | 65/11 |
| 3,731,575 | 5/1973 | Gelin | 83/344 |
| 3,771,981 | 11/1973 | Sears et al. | 65/9 |
| 3,873,290 | 3/1975 | Marzocchi | 65/2 |
| 3,892,157 | 7/1975 | Currie et al. | 83/346 X |
| 3,899,955 | 8/1975 | Selch | 407/52 X |
| 3,908,232 | 9/1975 | Okayama | 83/913 X |
| 4,163,653 | 8/1979 | Symborski et al. | 65/2 |

*Primary Examiner*—James M. Meister
*Attorney, Agent, or Firm*—John E. Curley

[57] ABSTRACT

A continuous cutter ring or hoop having relatively thick, large-angle chisel teeth to bend and break attenuated glass fibers in a glass fiber chopping assembly is disclosed. The continuous cutter is an annular ring or hoop of steel or other hard material which is formed having an outer circumference provided with integral, regularly spaced, raised cutting teeth. The continuous cutter is secured on a suitable cutter wheel which cooperates with a second wheel having an elastomer cot around its circumference with the glass fibers to be severed passing between the continuous cutter and the elastomer cot. The cutter teeth are generally chisel-shaped and sever the glass fiber strand without cutting or destroying the elastomer cot. The integrally formed cutter teeth will not separate from the cutter ring and are not subject to being misaligned.

7 Claims, 5 Drawing Figures

CONTINUOUS CUTTER FOR A GLASS FIBER CHOPPER

FIELD OF THE INVENTION

The present invention is directed generally to a glass fiber cutter assembly. More particularly, the present invention is directed to a continuous cutter ring for a glass fiber chopping assembly. Most specifically, the present invention is directed to an annular continuous cutter ring having integral chisel-shaped teeth on its circumference. The continuous cutter of the present invention may be formed either directly as an annular ring or hoop or may initially be a flat strip which first has teeth formed thereon and is then bent into a circular shape.

The ends of the strip are then joined to form the annular continuous cutter. The cutting or severing teeth are generally chisel-shaped and are thick in comparison to prior devices. These teeth act on the attenuated glass fiber strands to bend and break the strands into particulate glass fiber segments of desired length.

The continuous cutter ring is carried on the periphery of a rotatable cutter wheel with the teeth, which are on the outer peripheral surface of the ring, cooperating with a second rotatable wheel that is provided with an elastomer cot or tire on its periphery. The chisel-shaped teeth do not cut or destroy the elastomer cot thereby increasing the life of the cot. The continuous cutter ring with its integral teeth has a much greater life than prior devices and the integral teeth do not separate or break off from the cutter thereby increasing production efficiency and cutter life.

DESCRIPTION OF THE PRIOR ART

It has become known in the prior art to produce short lengths of glass fiber which are used in a number of industrial applications such as the making of glass fiber mats, shells, structural elements, reinforcing materials and the like. Molten glass is fed through a plurality of bushings and is attenuated into glass fiber strands. These strands are pulled from the bushing by suitable means such as cooperating rolls, belts and the like. The strands are usually sized by having sizing agents applied to them and are then cut or chopped into groups or bundles of uniform length by a cutting or chopping unit. U.S. Pat. No. 3,869,268, assigned to the assignee of the present application, is an example of an apparatus and method for chopping glass fibers and that patent is incorporated herein by reference. Glass fiber chopping assemblies are also shown in the following U.S. Pat. Nos.:

3,508,461; Stream
3,644,109; Klink et al.
3,731,575; Gelin
3,771,981; Sears et al.
3,873,290; Marzocchi
4,163,653; Symborski et al.

These patents are not intended to be a complete listing of all the prior art directed to glass fiber chopping assemblies but are intended to be exemplary thereof.

As may be seen particularly in U.S. Pat. No. 3,869,268, the glass fiber strands have been, in the prior art devices, cut or severed into short lengths by passage between an opposed pair of rotating wheels. The first wheel carries a plurality of individual, thin sharp blades which are secured in spaced, generally transverse slots on the outer periphery of the wheel. The cooperating second wheel has an elastomer cot or tire on its periphery and the strands are cut or severed by passing between the blades on the first wheel and the resilient surface on the second wheel with the blades contacting the elastomer cot during the cutting of the fibers.

The replaceable blade cutter wheels such as shown in U.S. Pat. No. 3,869,268 use thin blades which are similar to injector type razor blades. While these blades are individually inexpensive, the slots in the cutter wheel in which they are secured are difficult to clean and maintain and blade replacement is expensive and time consuming. Blade mislocation is a significant problem since it is difficult to properly seat the blade in the slot and to insure that the blade height is uniform across the cutter wheel. If the blades are mislocated, they are subject to flexural strains which cause them to fatigue and break quickly. Broken blades fall into the chopped glass fiber container and must be found and removed before the chopped glass can be further processed or used. Also, the spaces left on the cutting wheel by the missing broken blades produce long pieces of chopped glass fiber that reduce the quality of the batches which include them.

The thin sharp blades sever the glass fiber strands by pressing the strands against the elastomer cot on the second wheel. Since the strands are quite thin, it is difficult to properly position the two wheels so that the thin sharp blade cuts all of the glass fiber strands without penetrating the surface of the cot. Consequently, the cot surfaces soon become cut and are rapidly destroyed. The downtime necessary to replace the cots reduces production efficiency and the particles of the resilient material that are cut from the cot surface and fall into the batch of chopped glass fiber reduce the quality of the batches.

SUMMARY OF THE INVENTION

It is an object of the present invention to provide a continuous cutter ring for a glass fiber chopping assembly.

Another object of the present invention is to provide a continuous cutter ring having chisel-shaped teeth.

A further object of the present invention is to provide a continuous cutter ring having integrally formed teeth.

Yet another object of the present invention is to provide a continuous cutter ring which is inexpensive, durable and not subject to breakage.

As will be set forth in greater detail in the description of preferred embodiments, the continuous cutter ring in accordance with the present invention is an annular ring or hoop which has a plurality of equally spaced, generally chisel-shaped teeth integrally formed about its periphery. The annular ring can either be formed directly and have the teeth formed thereon or alternatively a flat strip of material can have teeth formed on it and then be bent into the proper shape and have the ends of the strip joined together to form the ring. The continuous cutter ring may be fabricated from tool steel or other similar material so that it will be long lasting and not easily broken. The teeth formed integrally on the outer periphery of the ring are generally chisel-shaped and have one generally flat side and one generally inclined side.

In contrast to the prior art cutting devices, the teeth of the continuous cutter ring in accordance with the present invention are formed as an integral part of the continuous cutter ring and accordingly will not become separated from the ring or become misaligned. As a result production quality of chopped glass fiber is improved since all of the teeth are properly spaced and remain on the wheel. In contrast with the individually secured blades of the prior art which fall out and which are subject to positioning errors, the cutter teeth of the present invention will not separate from the ring and consequently will not fall into the chopped glass fiber. Furthermore, since the teeth will not separate from the ring, the length of the chopped glass fibers remains uniform throughout the batch which was not the situation where the thin blades of the prior art could separate from the ring.

The teeth themselves are generally chisel-shaped and in contrast to the prior thin sharp blades, do not chop or cut the glass filaments so much by sharply piercing the filaments but rather by a bending and breaking action. As the teeth press the filaments or fibers against the elastomer cot wheel, the resilient material deforms, sharply bending the fibers around the teeth and effectively increasing the distance between teeth thereby breaking the fibers. Since the teeth are chisel-shaped they do not destroy the elastomer cot as do the thin, sharp blades of the prior art devices.

The production efficiency of glass fiber chopping apparatus is greatly improved by use of the continuous cutter in accordance with the present invention. Downtime due to individual blade replacement is effectively eliminated and in actual usage the continuous cutter has operated satisfactorily during a continuous run of more than 390 hours. This compares to an average production life of less than 24 hours for a replaceable blade type cutter head. The life of the elastomer cot on the cooperating second wheel has been correspondingly improved so that cot life is 10 to 50 times that obtained with prior thin sharp replaceable cutter blades. This is made possible by the chisel-shape of the teeth on the continuous cutter ring which do not cut or penetrate the elastomer cot. It will thus be seen that the continuous cutter ring having chisel-shaped teeth in accordance with the present invention provides a glass fiber cutter for use in a glass fiber chopping assembly which is efficient, dependable, durable, and which greatly increases production efficiency and quality.

BRIEF DESCRIPTION OF THE DRAWINGS

While the patentable features of the continuous cutter for a glass fiber chopper assembly in accordance with the present invention are set forth and particularity in the appended claims, a full and complete understanding of the invention may be had by referring to the description of preferred embodiments as set forth hereinafter and as may be seen in the accompanying drawings in which:

DESCRIPTION OF PREFERRED EMBODIMENTS

Figure 1:
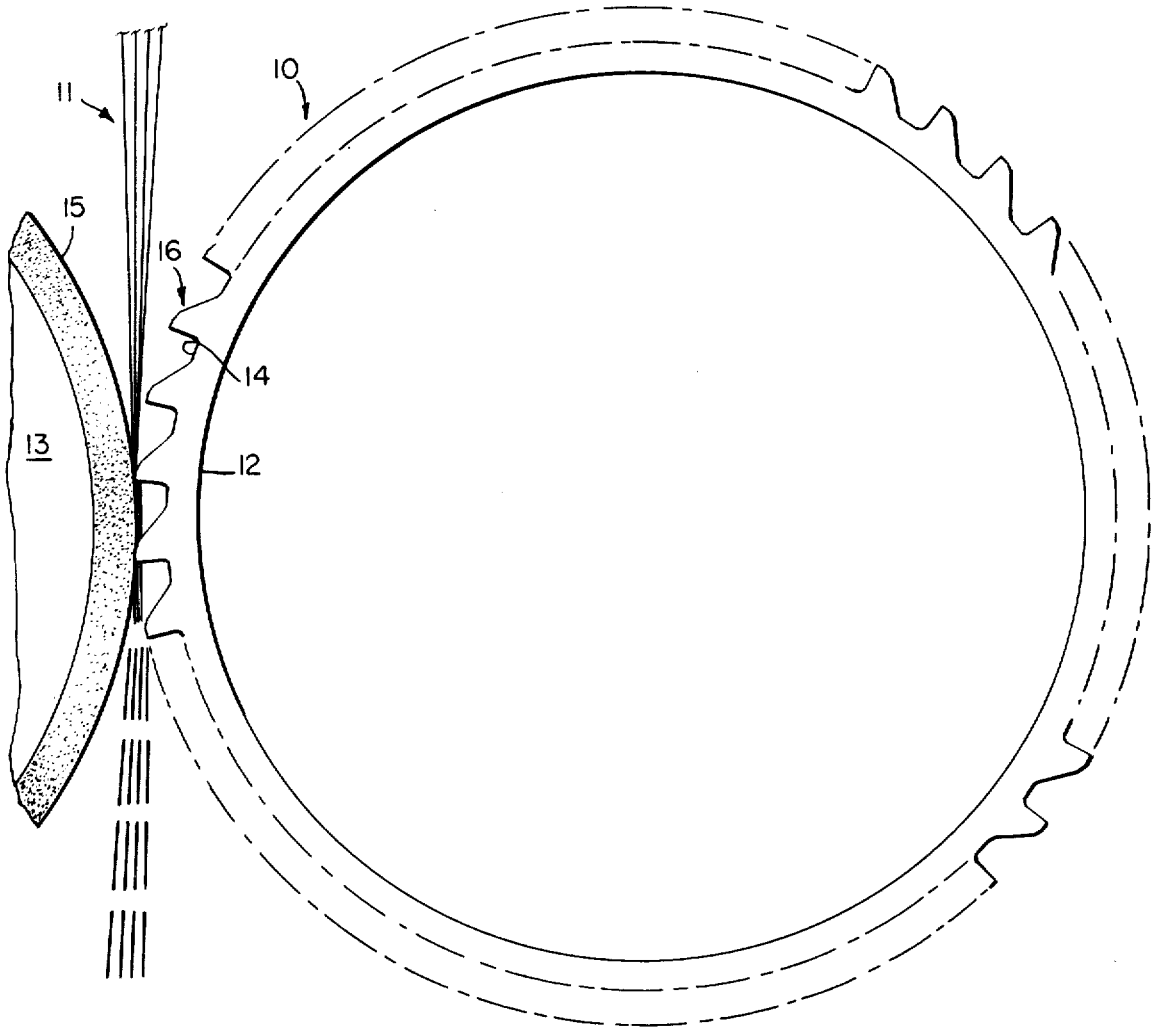
FIG. 1 is a side elevation view of a first preferred embodiment of a continuous cutter ring and cooperating elastomeric cot carrying wheel in accordance with the present invention showing typical tooth placement.

Turning initially to FIG. 1, there may be seen generally at 10, a first preferred embodiment of a continuous cutter ring in accordance with the present invention. Cutter ring 10 is annular and has an inner circumferential surface 12 and an outer peripheral surface 14. A plurality of equally spaced chisel-shaped teeth 16 are formed on the peripheral surface 14 and extend outwardly therefrom. It will be understood that continuous cutter ring 10 is intended for use in a glass fiber chopper assembly generally of the type shown in U.S. Pat. No. 3,869,268. Glass fibers 11 are chopped by cooperation of cutter wheel 10 and a second wheel 13 which has an elastomer cot 15 on its outer periphery. In the present invention, the continuous cutter ring 10 and cot wheel 13 are caused to rotate and the teeth 16 chop the glass fibers 11 which pass between cutter wheel 10 and cot wheel 13.

Figure 2:
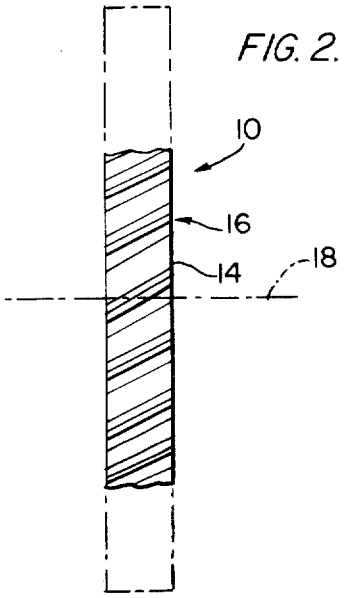
FIG. 2 is an end view of the continuous cutter ring of FIG. 1, again showing typical tooth placement.

As may be seen in FIG. 2, cutter ring 10 has a diameter substantially greater than its width. Teeth 16 are disposed on the periphery 14 and are angled with respect to an axis 18 of the cutter ring 10. In this preferred embodiment the teeth are positioned at an angle of 27° to the axis 18. This angle of the teeth 16 with respect to axis 18 can be varied in response to cutter rotational speed, fiber thickness, and other parameters.

In the first preferred embodiment, cutter ring 10 has an inner diameter of 5.5 inches, a thickness of 0.25 inch, and a tooth height of 0.15 inch. Cutter ring 10 carries 40 teeth 16 which are equally spaced on its peripheral surface 14 with each tooth being spaced 0.5 inch from the next succeeding one or at an angle of 9° from the next tooth. The cutter ring 10 has a width of 1.0 inch and is made from tool steel or a similar material.

Figure 3:
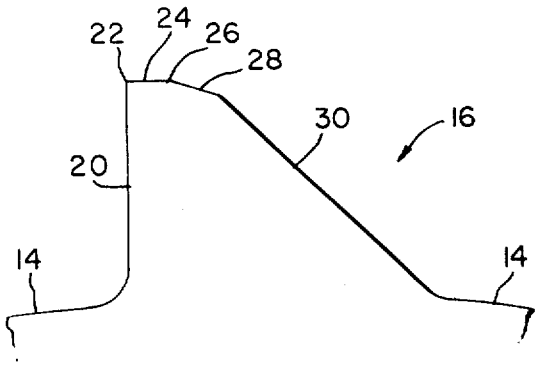
FIG. 3 is a side elevation view of a preferred embodiment of a chisel-shaped tooth of the continuous cutter ring.

As is shown in FIG. 3, each tooth 16 is generally chisel-shaped and is carried on the peripheral surface 14 of cutter ring 10. Each tooth 16 is formed having a vertical leading face 20 which extends upwardly to a point defined by the upper edge of face 20 and a first edge 22 of first, generally horizontal surface 24. A second, transition surface 28 extends downwardly and away from a second edge portion 26 of horizontal surface 24. Transition surface 28 terminates at its intersection with inclined tooth skirt 30 which intersects the peripheral surface 14 of the cutter ring 14. In the preferred embodiment, as indicated previously, the vertical leading face 20 of tooth 16 has a height of 0.15 inch and extends across the width of ring 10. The horizontal surface 24 has a width of 0.02 inch. Transition surface 28 has a width of 0.04 inch and declines from horizontal surface 24 at an angle of 15°. Tooth skirt 30 is angled at 45° from leading face 20. As may be seen, and as has been previously discussed, each tooth 16 is chisel-shaped and does not pierce the glass fibers as do the prior thin blades, instead, it stretches and bends them to effect the cutting or chopping of the strands into short pieces. The placement and size of the teeth 16 is such that at any time during filament cutting or chopping, the filament is held against the elastomer cot 15 on the second wheel 13 by at least two of the teeth 16. These teeth slightly deform the resilient surface of the elastomer cot 15 of the second wheel 13 without permanently cutting or scraping it. As the fiber or filament held between the teeth is stretched and deformed, it is caused to break and to thus be cut or chopped into suitable lengths. Since the cutter wheel, second wheel, and filaments may be moving at a rate of 10,000 feet per minute, the chopping is done very rapidly and without the deterioration of the elastomer cot that has occurred in prior devices. Additionally, as was discussed previously, since teeth 16 are formed integrally with the cutter ring 10, and due to their relative thickness in comparison to prior art devices, they will not become broken or separate from the cutter wheel as occurs in prior devices.

Figure 5:
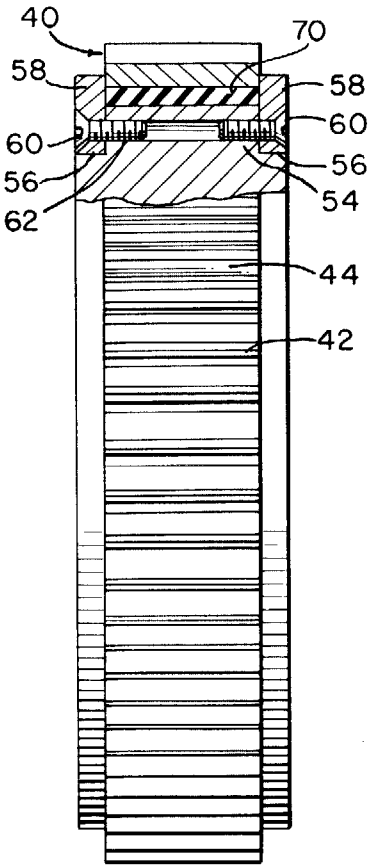
FIG. 5 is an end view, partly in section of the second preferred embodiment of FIG. 4.
Figure 4:
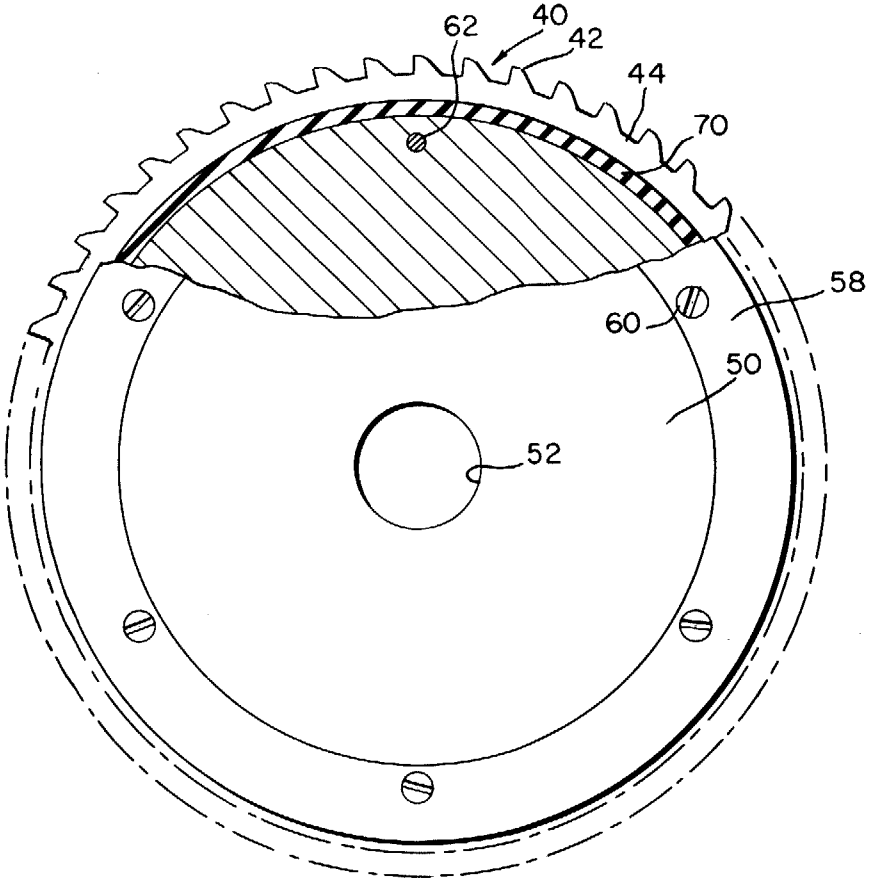
FIG. 4 is a side elevation view, partly in section, of a second preferred embodiment of a continuous cutter ring in accordance with the present invention, with the ring being mounted on a cutter wheel.

Turning now to FIGS. 4 and 5, these may be seen a second preferred embodiment 40 of a cutter ring in accordance with the subject invention. As may be seen in FIG. 5, this cutter ring 40 differs from the first embodiment 10 in that chisel-shaped teeth 42 extend across an outer peripheral surface 44 of ring 40 generally parallel to the axis of ring 40.

Cutter ring 40 is secured to a generally disk-shaped cutter wheel 50 which, in turn, may be mounted for rotation by placement of a rotatable shaft of a chopper assembly (not shown) in central aperture 52 of cutter wheel 50 in a known manner. Cutter wheel 50 has a reduced thickness portion 54 at its outer edge which forms two shoulders 56 that support clamping rings 58. These clamping rings 58 are attached to cutter wheel 50 by insertion of screws 60 into corresponding threaded holes 62 in the reduced thickness portion 54 of cutter wheel 50. Cutter ring 40 is held on the outer periphery of cutter wheel 50 by tightening of the two clamping rings 50. An elastomer expansion ring 70 may be placed between the cutter ring 40 and the cutter wheel 50 to center the cutter ring 40 about the rotatable shaft and to cushion any shocks or vibrations which may occur during chopping and to prevent their transmission back to the drive mechanism.

The dimensions and materials of the second preferred embodiments of the cutter ring 40 are similar to those of the first preferred embodiment of the cutter ring 10. The difference between the two is the angle at which the teeth are placed on the outer periphery of the cutter. As was discussed previously, this angle can be selected depending on various parameters such as cutter rotational speed, glass fiber attenuation speed, thickness of the filaments being cut and the like.

The cutter ring may be formed initially as a cylindrical element into which the teeth are cut or formed by, for example, a milling, hobbing, or shaping operation. Alternatively, a flat strip of material may have teeth formed on its surface by a similar machining operation or by a punching or other cutting operation. Once the teeth are formed, the strip can then be bent into a circular shape and have the ends formed together by welding or the like.

In operation, as has been discussed previously, the cutter ring is secured to a cutter wheel of a glass fiber chopper apparatus and is positioned to cooperate with the second wheel which carries the elastomer cot on its periphery. Molten glass is formed into filaments by a suitable bushing and the filaments are sized, if desired, and are cut into short segments by the cutter ring which is rotatably carried by the cutter wheel. The chisel-shaped teeth on the cutter ring do not break or become dulled rapidly and do not destroy the resilient surface of the elastomer cot. In this way production efficiency is greatly improved since both the cutter ring and cot wheel have a much greater life than in prior art devices. Furthermore, production quality is greatly improved because broken blades and pieces of the elastomer cot do not contaminate the cut glass fiber batches and the batch content is much more uniform in length than in prior devices because the prior problem of broken blades is eliminated.

It will thus be seen that there has hereinabove been fully and completely described a continuous cutter ring having chisel-shaped teeth for use in a glass fiber chopper assembly. While the patentable features are set forth with particularity in the following claims, it will be obvious to one of skill in the art that a number of changes in, for example, the dimensions of the cutter ring, the specific materials used, the means used to form the cutter teeth, and the like could be made without departing from the true spirit and scope of the invention and that the invention is to be limited only by the claims.

I claim:

1. A continuous cutter ring for use in a glass fiber chopper apparatus to sever glass fiber filaments passing between said cutter ring and a cooperating elastomeric cot ring into chopped lengths of glass fibers, said cutter ring comprising:

an annular ring, said ring having an inner circumferential surface and an outer periphery; and a plurality of chisel-shaped teeth integrally formed on said outer periphery, each of said teeth having a leading face extending radially outwardly from said outer periphery, a horizontal surface extending rearwardly in the direction of rotation of said cutter ring from an upper edge of said leading face, a transition surface extending downwardly and rearwardly from said horizontal surface, and a skirt extending downwardly and rearwardly from said transition surface to said outer periphery of said annular ring, said teeth being equally spaced on said outer periphery and extending generally across said outer periphery, so that the glass fiber filaments are sharply bent by the cooperation of said horizontal surface portion of said chisel-shaped teeth and said elastomeric cot ring to effect the severance of said glass fiber filaments by a bending and breaking action.

2. The continuous cutter ring of claim 1 wherein said teeth extend across said outer periphery at an angle to the axis of said ring.

3. The continuous cutter ring of claim 2 wherein said angle is substantially about 27°.

4. The continuous cutter ring of claim 1 wherein said teeth extend across said outer periphery generally parallel to the axis of said ring.

5. The continuous cutter ring of claim 1 wherein said annular ring is secured to a cutter wheel of the glass fiber chopper apparatus by a pair of spaced clamp rings, said clamp rings being secured to spaced sides of the cutter wheel at an outer portion of the wheel, said continuous cutter ring being held between said spaced clamp rings.

6. The continuous cutter ring of claim 5 wherein said outer portions of said cutter wheel are provided with shoulders, said clamp rings engaging said shoulders.

7. The continuous cutter ring of claim 5 wherein an elastomer expansion ring is placed between said inner circumferential surface of said continuous cutter ring and an outer circumferential surface of said cutter wheel.

* * * * *